United States Patent [19]

Guilinger

[11] Patent Number: 4,892,628

[45] Date of Patent: Jan. 9, 1990

[54] ELECTRODEPOSITION OF AMORPHOUS TERNARY NICKEL-CHROMIUM-PHOSPHORUS ALLOY

[75] Inventor: Terry R. Guilinger, Albuquerque, N. Mex.

[73] Assignee: The United States Department of Energy, Washington, D.C.

[21] Appl. No.: 338,013

[22] Filed: Apr. 14, 1989

[51] Int. Cl.[4] ..... C25D 3/56

[52] U.S. Cl. ..... 204/44.7; 204/43.1

[58] Field of Search ..... 204/43.1, 44.7

[56] References Cited

U.S. PATENT DOCUMENTS 3,917,517 11/1975 Jordan et al. ..... 204/44.7

4,461,680 7/1984 Lashmore ..... 204/41

*Primary Examiner*—G. L. Kaplan

*Attorney, Agent, or Firm*—Armand McMillan; James H. Chafin; Judson R. Hightower

[57] ABSTRACT

Amorphous ternary nickel-chromium-phosphorus alloys are electrodeposited from a bath comprising a nickel salt, a chromium salt, a phosphorus source such as sodium hypophosphite, a complexing agent for the nickel ions, supporting salts to increase conductivity, and a buffering agent. The process is carried out at about room temperature and requires a current density between about 20 to 40 A/dm$^2$.

10 Claims, 2 Drawing Sheets

ELECTRODEPOSITION OF AMORPHOUS TERNARY NICKEL-CHROMIUM-PHOSPHORUS ALLOY

The U.S. Government has rights in this invention pursuant to Contract No. DE-AC04-76DP00789 between the U.S. Department of Energy and the AT&T Technologies, Inc.

BACKGROUND OF THE INVENTION

The present invention relates to the formation of amorphous ternary nickel-chromium-phosphorus alloys by electrodeposition.

Amorphous metal alloys have been studied extensively in the past two decades and have been found to possess a number of superior chemical and physical properties. Among these are excellent corrosion resistance, desirable magnetic properties, and good wear and abrasion resistance.

Heretofore, such alloys have been prepared by several techniques, the most widely used of which being the rapid quenching of the alloy from its melt. While it is possible to produce a variety of different alloys in thin ribbon or wire form in that manner, the technique has inherent limits in the thickness of the stock it can produce and cannot be used to form irregular shapes. Sputtering and plasma deposition have also been used to produce thin foils. As disclosed by A. K. Hayes in U.S. Pat. No. 4,626,448, the latter technique, in particular, has been capable of producing thin adherent coatings of amorphous alloys on relatively larger, complex shapes. Both these techniques again are limited in terms of the thickness of deposit that can be formed within a reasonable time without the creation of destructive residual stresses. Electroless nickel plating has also been used to produce a small number of nickel-based amorphous alloys. While the technique has the capability of building thicker deposits, it is rather limited in the variety of alloys that it can produce and does not allow variation of composition and properties during the course of deposition.

An electron beam evaporation process has been disclosed by K. Matsubara in U.S. Pat. No. 3,900,585 for coating a solid metal onto a substrate. However, in that activated evaporation process which utilizes a plasma, the substrate must serve as cathode and, therefore, must be conductive and the resulting coatings are not amorphous. Iron can also be coated onto a substrate by a plasma-enhanced deposition method involving iron pentacarbonyl in a radio frequency power-induced glow discharge reactor, but again the resulting coating consists of iron crystallites embedded in an iron oxide matrix (D. M. Wroge and D. W. Hess, "Plasma-enhanced Deposition of Iron/Iron Oxide Films", Report LBL-9879, 1979).

Amorphous secondary and ternary alloys have been prepared by chemical vapor deposition, as disclosed in copending patent application Ser. No. 170,228, filed on Mar. 18, 1988. While many advantages attend the chemical deposition approach, e.g., the possibility of reproducing complex shapes and virtually unlimited thicknesses of deposits, the methods have practical limitations in terms of the type of materials and apparatus required which curtail its usefulness for large scale industrial applications.

Electrodeposition has been used to form coatings of binary amorphous alloys of nickel-phosphorus and nickel-chromium (Gamblin, U.S. Pat. Nos. 4,554,219; Yanagioka, 4,113,248; and Lashmore, 4,461,680). A chromium-nickel alloy has also been deposited electrochemically in a bath containing hypophosphite (Jordan, 3,917,517). However, no ternary nickel-phosphorus-chromium alloy has been obtained in that manner.

Finally, an amorphous quaternary iron-nickel-chromium-phosphorus alloy was electrodeposited by Feng et al. [Metallic Corrosion, Proceedings: Eighth International Congress on Metallic Corrosion, Frankfurt, Germ., 2, 1121–26 (1981)]. Again, no nickel-phosphorus-chromium alloy was produced and the basic problems of that process remain to be solved, i.e., low current efficiency of deposition and high internal stress in the deposited alloy.

In view of the prior art and its limitations, it is an object of this invention to provide a novel technique to produce amorphous ternary nickel-phosphorus-chromium alloys. Another object is to produce these alloys on an industrial scale. A further object is to form the amorphous ternary alloys by electrodeposition and obtain alloy layers of 10 microns and up. A still further object is to provide a technique that can operate at high current densities.

Additional objects, advantages, and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

In accordance with the invention, amorphous nickel-chromium-phosphorus alloys are formed by electrodeposition from a bath containing a chromium salt and a nickel salt in a weight ratio of about 3:1, a phosphorus source at about 0.3M P concentration, about 0.3M of a complexing agent for the nickel ions, about 0.1M of a supporting salt to increase the bath conductivity, and about 1M of buffering agent with maximum buffer capacity near a pH of 3. Examples of these materials are chromium and nickel chlorides, sodium hypophosphite, sodium citrate, ammonium chloride, and formic acid, respectively. Other conventional electroplating additives may be incorporated for their expected contribution, provided that they do not interfere with the formation of the amorphous alloys desired. The electrodeposition is carried with an applied current density within the range of about 20 to about 40 $A/dm^2$ at a temperature within the range of about 20° to 30° C. and a pH within the range of about 2.8 to about 3.5.

DETAILED DESCRIPTION OF THE INVENTION

Figure 1:
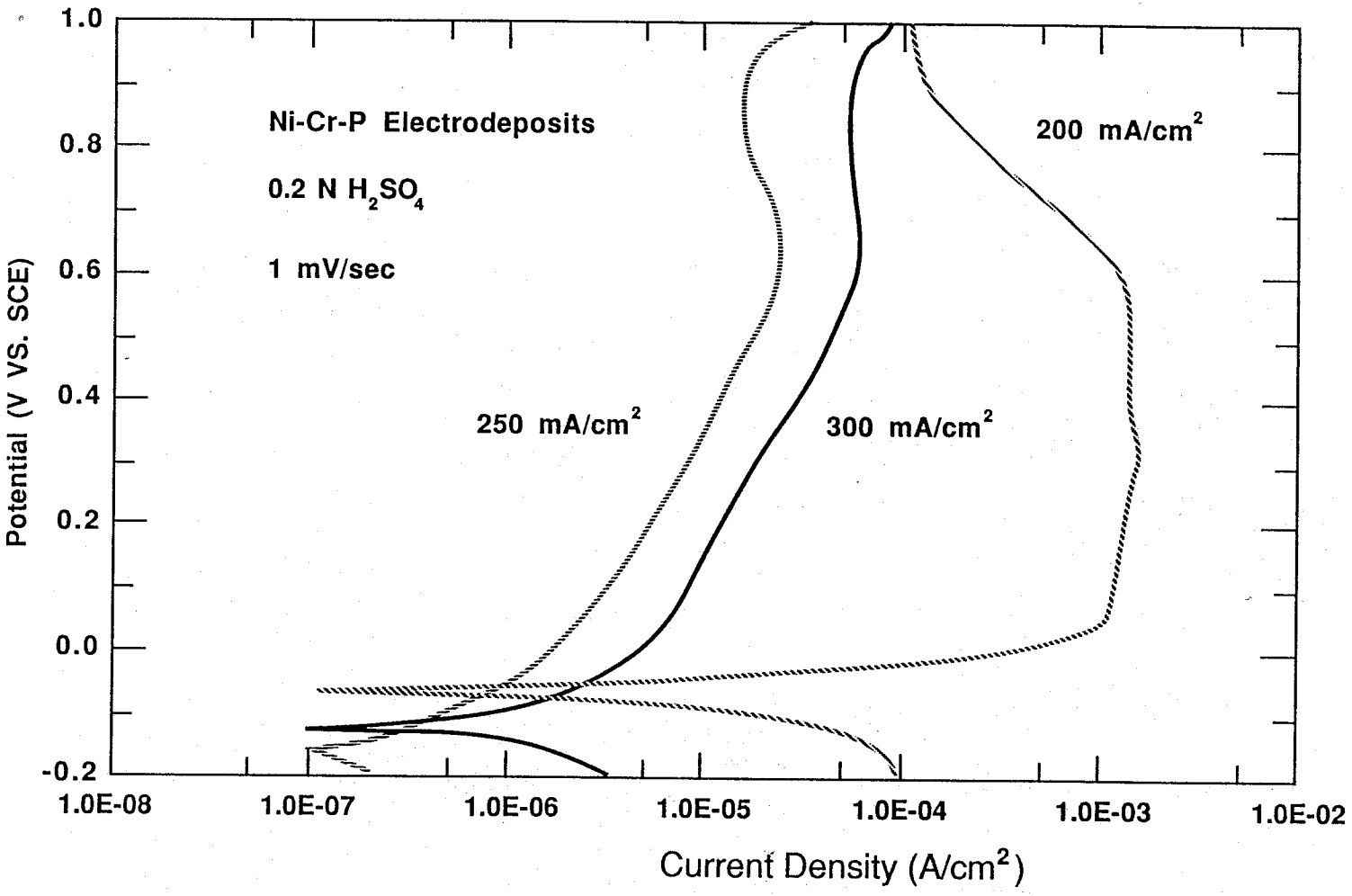
FIG. 1 graphically compares the polarization behavior of three nickel-chromium-phosphorus electrodeposits made under conditions within and without the process of the invention.

Because of the strategic importance of chromium, there is an impetus to use thin coatings of chromium-containing alloys, rather than pure chromium coatings, for protecting base materials from corrosive environments. The outstanding corrosion resistance of nickel-chromium-phosphorus alloys produced by rapid quenching, ion implantation, or chemical deposition techniques is well known. However, for various reasons, these techniques do not lend themselves to industrial scale applications.

Electrodeposition, on the other hand, has been found quite useful for industrial scale preparation of thin coatings with good appearance, corrosion resistance, and excellent surface properties. It has now been determined that electrodeposition can be used for the formation of amorphous ternary nickel-phosphorus-chromium alloys possessing all the desirable properties of such alloys, and that it can do that with greater efficiency than all other processes employed heretofore.

The essential ingredients of the typical plating bath in which such electrodeposition can take place are: nickel salts, chromium salts, a source of phosphorus, a complexing agent for the nickel ions, supporting salts to increase the conductivity of the bath and a buffer. The nickel and chromium salts can be chlorides, e.g., $NiCl_2.6H_2O$ and $CrCl_3.6H_2O$. The phosphorus source can be sodium hypophosphite or a mixture of phosphorus acid and phosphoric acid in the weight ratio of 5:4. Usable complexing agents include sodium citrate, sodium lactate, sodium succinate, glycine, and the like. Salts like ammonium chloride are added to increase bath conductivity, thus reducing resistive heating of the bath solution. Buffers such as formic acid are used to maintain the plating bath pH near 3. Other substances can be used in the bath to promote adherence of the deposit, reduce deposit stress, or alter the surface tension of the bath solution. Such additives include saccharin as well as other chemicals conventionally used in electroplating practice.

The preferred proportions of the essential ingredients of the plating bath are: chromium salt to nickel salt, 3:1 by weight; phosphorus source, 0.3 molar P; complexing agent, 0.3 molar; and supporting salt, 0.1 molar, and buffer, 1.0M. Other additives, when used, are present in conventional concentrations.

The applied current density can be varied between about 20 and about 40 $A/dm^2$, with higher densities yielding higher chromium content in the deposits. A bath solution pH of about 3 results in greater efficiency, inasmuch as hydrogen evolution is depressed at that level. The plating process is preferably carried out at or near room temperature.

The amorphous ternary alloy produced by the process of this invention can be deposited on any conductive substrate conventionally plated by electrodeposition. Usable substrates include copper, iron, steel, aluminum, tin, and the like.

The following examples will serve to illustrate the invention in greater operational detail. They are not to be construed as limitations of the invention beyond the scope of the appended claims.

EXAMPLES

Degreased 1 $cm^2$ platinum disks were plated in a bath and under conditions having the characteristics listed in Table I. The bath was vigorously stirred during the plating process.

TABLE I

| Bath Composition | |
|---|---|
| $NiCl_2.6H_2O$ | 30 g/l |
| $CrCl_3.6H_2O$ | 100 g/l |
| HCOOH, | 35 ml/l |
| KBr | 17.3 g/l |
| $NH_4Cl$ | 50 g/l |
| $Na_3(cit.).2H_2O$ | 80 g/l |
| $H_3BO_3$ | 35 g/l |
| $NaH_2PO_2.H_2O$ | 30 g/l |
| pH | ca. 3.0 |
| Temperature | ca. 21° C. |

Three different applied current densities were used with this bath, namely 200, 250, and 300 $mA/cm^2$. The electrodeposits obtained were analyzed by X-ray fluorescence (XRF) and by X-ray diffraction (XRD) to determine crystallinity. XRD showed that the deposits made at 250 and 300 $mA/cm^2$ were completely amorphous while the presence of small quantities of crystalline $Ni_2P$ was indicated in the material plated at 200 $mA/cm^2$.

Table II shows the composition of the three deposits as measured by XRF. Phosphorus contents were uniform at 24 to 28 atom% over each of the deposits. However, the nickel and chromium contents varied considerably depending on deposition current density. High chromium contents were associated with high deposition current density.

TABLE II

| | Composition of electrodeposited Alloys | | | |
|---|---|---|---|---|
| | Current Density ($mA/cm^2$) | Ni (atom %) | Cr (atom %) | P (atom %) |
| Example 1 | 200 | 65 | 7 | 28 |
| Example 2 | 250 | 51 | 23 | 26 |
| Example 3 | 300 | 21 | 55 | 24 |

Anodic polarization experiments were performed on each of the three deposits of the examples to determine their dissolution behavior in 0.2N $H_2SO_4$ and in 0.2M HCl. FIG. 1 shows that the deposits formed at 250 and 300 $mA/cm^2$ contained enough chromium to produce a wide passive region (ca. 1 volt) in their polarization behavior in the sulfuric acid with current densities varying between 10 and 100 $\mu A/cm^2$. On the other hand, the deposit formed at 200 $mA/cm^2$ dissolved actively over a wide range of potential due to the low content of chromium throughout the deposit.

Figure 2:
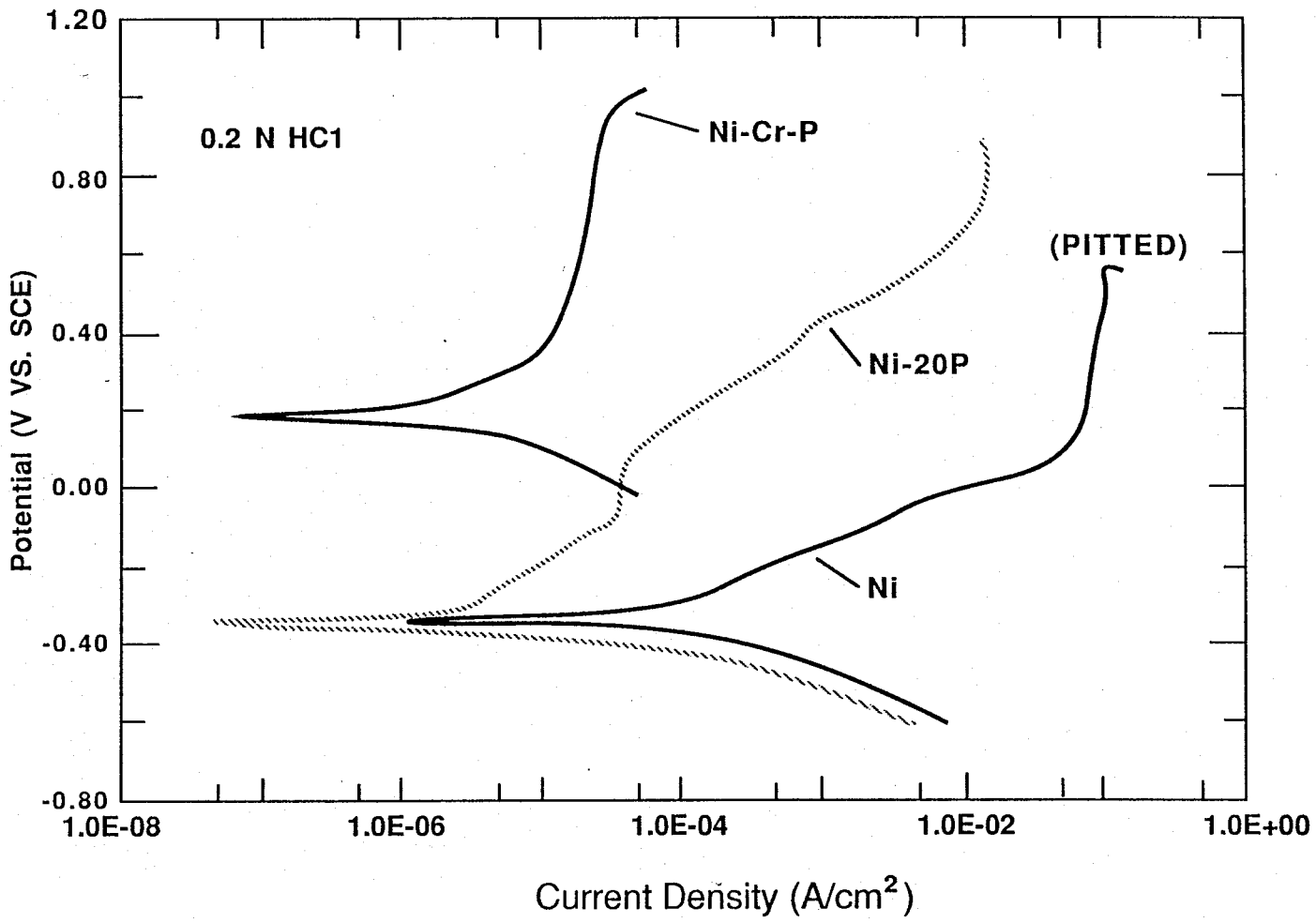
FIG. 2 compares the polarization behavior in hydrochloric acid of a ternary alloy according to the invention and that of deposited nickel and a binary nickel-phosphorus alloy.

The polarization of high chromium deposit (Example 3) was compared with pure nickel and glassy Ni-20P prepared by melt spinning. FIG. 2 shows the benefits of added chromium on corrosion behavior of nickel and alloys in 0.2N hydrochloric acid. Pure nickel exhibits high corrosion rates due to localized pitting at potentials anodic of open circuit. Amorphous Ni-P does not pit in hydrochloric acid but does dissolve uniformly at relatively high rates. Amorphous Ni-Cr-P with at least 10 atom% Cr exhibits neither local nor uniform corrosion because chromium stabilized the passive film formed on the alloy.

Deposits plated at all three current densities were very adherent, as shown by standard bending tests. Little or no porosity was detected on alloys deposited on copper.

Similar tests, as well as additional comparative tests, carried out on amorphous ternary nickel-phosphorus-chromium alloys and on some binary alloys and commercial stainless steels have further confirmed the excellent properties of the new electrodeposited materials. The tests have been published by T. R. Guilinger in "Corrosion Resistance of Electrodeposited Amorphous Ni-P-Cr Alloys", Proc. Symp. on Corrosion, Electrochemistry and Catalysts of Metallic Glasses, Ed. R. B. Diegle, Electrochemical Society Meeting, Honolulu, Hawaii, October 1988, Vol. 88-1. This article is incoporated herein by reference.

The proceding examples demonstrate that electrodeposition can be employed to produce thick, amorphous nickel-phosphorus-chromium alloy layes that are strongly adherent, highly resistant to corrosion, with low stress and porosity. That the electrodeposits meet these criteria has been shown in the following ways: bend tests, heat and quench tests, and peel tests all qualitatively showed excellent adherence to substrates; potentiodynamic corrosion tests in pitting and nonpitting electrolytes have indicated that the electrodeposits have corrosion resistance superior to that of 304 stainless steel; beam deflection and spiral contractometer tests showed stresses from 2000–3000 psi tensile, which compares to stresses as high as 20,000 psi tensile for some electrodeposited pure nickel; porosity tests in aqueous acids and in accelerated atmospheric exposure showed no porosity for deposits as thin as 2 μm.

Deposits up to about 10 μm thick have been obtained so far, with no observable upper limit detected.

From the foregoing description of the invention, a person skilled in the art can easily ascertain its eesential characteristics and, without departing from its spirit and scope, can make various changes and modifications to adapt it to different usages and conditions.

What is claimed is:

1. A method of forming amorphous ternary nickel-phosphorus-chromium alloy deposits by electrodeposition on an electrically conductive substrate, comprising subjecting said substrate to an applied current density between about 20 and 40 A/dm$^2$ at a temperature from the range of about 20 ° to 30° C. in a bath comprising: a chromium salt and a nickel salt in a weight ratio of about 3:1, a phosphorus source at about 0.3M P concentration; about 0.3M of a complexing agent; about 0.1M of a supporting salt; and about 1.0M of buffer.

2. The method of claim 1, wherein the phosphorus source is sodium hypophosphite.

3. The method of claim 1, wherein the phosphorus source is a mixture of phosphorus acid and phosphoric acid in a weight ratio of about 5:4.

4. The method of claim 1, wherein the chromium and nickel salts are chlorides.

5. The method of claim 1, wherein the complexing agent is selected from the group consisting of sodium citrate, sodium lactate, sodium succinate, glycine, and mixtures thereof.

6. The method of claim 1, where the supporting salt is ammonium chloride.

7. The method of claim 1, wherein the buffer is formic acid.

8. The method of claim 1, wherein the substrate is steel.

9. A method for electrodepositing amorphous nickel-chromium-phosphorus alloys on an electroconductive substrate, comprising subjecting the substrate to an applied current density between about 200 to about 300 mA/cm$^2$, at room temperature, in a bath at about pH 3.0, comprising

| | |
|---|---|
| $NiCl_2.6H_2O$ | 30 g/l |
| $CrCl_3.6H_2O$ | 100 g/l |
| HCOOH | 35 ml/l |
| KBr | 17.3 g/l |
| $NH_4Cl$ | 50 g/l |
| $Na_3$(citr.).$2H_2O$ | 80 g/l |
| $H_3BO_3$ | 35 g/l |
| $NaH_2PO_2.H_2O$ | 30 g/l |

10. The method of claim 9, wherein a 5:4 by weight mixture of phosphorous acid and phosphoric acid is used in place of sodium hypophosphite.

* * * * *